US005383347A

United States Patent [19]

Riviere et al.

[11] Patent Number: 5,383,347

[45] Date of Patent: Jan. 24, 1995

[54] CONTINUOUS EXTRUSION OF COMPLEX ARTICLES

[76] Inventors: Alfredo V. Riviere, Calle el Lindero, Quinta Aurat Cerro Verde, 20, Caracas, Venezuela; Navtej S. Saluja, 26 Heath Rd., #3, Arlington, Mass. 02174

[21] Appl. No.: 65,616

[22] Filed: May 21, 1993

[51] Int. Cl.[6] ..... B21C 31/00

[52] U.S. Cl. ..... 72/260; 72/262

[58] Field of Search ..... 72/256, 260, 262; 164/305, 322

[56] References Cited

U.S. PATENT DOCUMENTS

| | | | |
|---|---|---|---|
| 2,223,385 | 12/1940 | Plessman | 164/322 |
| 3,872,703 | 3/1975 | Green . | |
| 4,044,587 | 8/1977 | Green et al. . | |
| 5,152,163 | 10/1992 | Hawkes et al. . | |
| 5,157,955 | 10/1992 | Hawkes et al. . | |

FOREIGN PATENT DOCUMENTS

| | | |
|---|---|---|
| 1370894 | 10/1974 | United Kingdom . |
| 1504890 | 3/1978 | United Kingdom . |
| 1507303 | 4/1978 | United Kingdom . |
| 1566152 | 4/1980 | United Kingdom . |
| 1590766 | 6/1981 | United Kingdom . |

OTHER PUBLICATIONS

Long, H. W. "Some differences between direct and indirect extrusion of aluminium alloys".

Langerweger, J. and Maddock B. "Recent Developments in Conform and Castex Continuous Extrusion Technology" *Light Metal Age*, 23–28, Aug. 1988.

Maddock, B. "Aluminium rod and other products by Conform" *Wire Industry*, 728–731, Dec. 1987.

Parkinson, R. D. "Continuous cladding–Conform process" *Wire Industry*, 728–731, Apr. 1986.

*Primary Examiner*—Lowell A. Larson

*Attorney, Agent, or Firm*—Choate, Hall & Stewart

[57] ABSTRACT

An apparatus for continuously extruding shaped articles includes providing a frictional extrusion source for extruding a feed material, a chamber for holding frictionally extruded material received from the extrusion source, a plurality of die chambers, each of the die chambers receiving extruded material from the holding chamber, means for directing extruded material from the holding chamber to each die chamber for selectively filling each die chamber with extruded feed material and means for monitoring filling of each die chamber of said plurality of die chambers with extruded feed material. The directing means is responsive to the monitoring means so that extruded material can be directed from a filled die to chamber to an empty die chamber for subsequent filling, thereby permitting continuous extrusion.

46 Claims, 6 Drawing Sheets

CONTINUOUS EXTRUSION OF COMPLEX ARTICLES

FIELD OF THE INVENTION

The present invention relates to a method and apparatus for continuously producing a shaped article using frictional extrusion technology.

BACKGROUND OF THE INVENTION

The advantages of working a metal in its solid state, the equilibrium state under most working conditions, rather than its liquid state are well known. The enhanced reactivity of the metal in the liquid state makes it prone to reaction with the atmosphere or mold, die or furnace elements, resulting in the formation of solid inclusions and/or incorporation of dissolved gases into the melt. Processes involving molten metal also necessarily involve phase transformation associated with solidification shrinkage, evolution of dissolved gases and a number of casting defects.

On the other hand, working metal in the solid state requires a large amount of energy to deform the metal, necessitating heavy and expensive machinery. It is known to extrude a material, typically a soft metal (e.g., aluminum, copper, magnesium, zinc, silver and alloys thereof) in the form of a continuous cable, tube or ribbon through a die by maintaining fictional engagement of the material with a passageway defined by driving and non-driving surfaces, such that frictional drag maintains extrusion pressure and urges the material through the die ("frictional extrusion"). This process has been typically used for preparing continuous lengths of cable or tubing. The reader is directed to the prior art on continuous extrusion for more specific details, e.g., GB 1,370,894, GB 1,566,152, and GB 1,590,766.

It is desirable to develop an extrusion process capable of use for preparing massive structures of non-uniform cross-section because the process is relatively inexpensive in comparison to conventional metal-working processes, such as forging, and provides inherently higher quality materials than some less expensive casting processes. However, extrusion of large articles with non-uniform cross-sectional areas results in variation of extrusion processing conditions, such as velocity and pressure, along the extrusion pathway. Such processing variations can result in increased porosity and/or inclusions, as well as other structural defects in the final product.

In conventional extrusion processes, the surface over which extrusion occurs is small and the extrusion pressure is correspondingly small, as well. When it is desired to extrude a metal into a die chamber of reasonable complexity, the material must move (be extruded) over a large regions of varying cross-sectional area. The forces on the material are required to be very large. Hence, conventional continuous extrusion processes are not readily amenable to the preparation of large metal pieces.

Frictional extrusion processes have addressed the problem of extruding product (typically large bore tubing) having a final dimension greater than the largest dimension of the feed material (a controlling parameter in extrusion processes). GB 1,507,303 discloses an apparatus for extruding a product having a dimension greater than the largest dimension of the feed material by gradually increasing the passage dimension in the direction from the inlet end to the outlet end. GB 1,566,152 discloses the use of multiple feeds into an intermediate chamber from which one or more die orifices may extend. U.S. Pat. No. 5,152,163 discloses the production of thin-walled large cross-section products extruded with the use of mixer plates and feeder blocks. None of the prior art references have addressed the unique processing problems related to forming discreet complex articles.

GB 1,504,890 discloses continuous extrusion of shaped articles, whose cross sectional areas are substantially uniform. Further, because the mold is in a carousel housed within the driving or non-driving surfaces of the apparatus, the size of the shaped articles is necessarily small and the shape is rather simple.

It is an object of the present invention to provide a method and apparatus for the extrusion of large metal pieces with complex shape that cannot be readily prepared using conventional extrusion processes.

The present invention provides a high quality article at a lower cost than conventional metal-working processes.

SUMMARY OF THE INVENTION

In one aspect of the invention, a frictional extrusion apparatus for continuous extrusion of shaped articles includes a frictional extrusion source, at least one chamber for holding frictionally extruded material received from the extrusion source, means defining a plurality of die chambers, means for directing extruded material from the holding chamber to each die chamber for selectively fig each die chamber with extruded feed material and means for monitoring the filling of each die chamber with extruded material. The directing means is responsive to the monitoring means so that extruded material can be directed from a filled die to chamber to an empty die chamber for subsequent filling, thereby permitting continuous extrusion.

"Frictional extrusion source" is used in the conventional sense to means any apparatus or portion thereof which utilizes the friction engagement of a feed material between moving and non-moving surfaces to generate extrusion pressure.

By "means defining a die chamber", as that term is used herein, it is meant a hollow section geometry defined by the machined surfaces of sectional dies and a machined mandrel. The resulting extruded article ("extrusion") has surface contour and dimensions determined by the surface contour of the sectional dies, shape of the mandrel adjoining the sectional dies and the clearance between the mandrel and sectional dies.

By "directing means", as that term is used herein, it is meant any apparatus or portion thereof which acts a conduit for selectively directing the extruded material from the holding chamber and into each die chamber. The directing means may include individual conduits for supplying each of the plurality of die chambers with extruded material and means for selectively supplying each conduit with feed material. Alternatively, directing means may include a conduit capable of selectively directing extruded feed material to a plurality of die chambers and means for selectively supplying individual die chambers with extruded feed material.

By "selectively filling", as that term is used herein it is meant the ability to direct extruded material to a selected point in the extrusion apparatus, where a die chamber is positioned for receiving the extruded material.

In another aspect of the present invention, a frictional extrusion apparatus for continuous extrusion of shaped articles includes a frictional extrusion source defining a passageway the passageway including an entry point for introduction of a feed material and an exit point for release of frictionally extruded material. The apparatus further includes a plurality of chambers for holding the frictionally extruded material. The invention further includes a plurality of outlet conduits, each outlet conduit having a first end in communication with an exit end of the respective holding chamber, and a sealing means disposed in each outlet conduit. Means defining a plurality of die chambers is provided, each die chamber containing an inlet port defined by a surface of the die chamber, each inlet port in communication with a second end of the outlet conduit of the respective holding chamber for receiving the extruded feed material. Means for monitoring the filling of each die chamber with extruded feed material and means for opening and closing each sealing means is provided. The monitoring means is capable of generating an input signal and the means for opening and closing is responsive to the input signal of the monitoring means.

In another aspect of the invention, a frictional extrusion apparatus for continuous extrusion of shaped articles includes a frictional extrusion source defining a plurality of passageways, each passageway including an entry point for introduction of a feed material and an exit point for release of a frictionally extruded material and a plurality of chambers for holding the frictionally extruded material. The apparatus provides a plurality of branched outlet conduits, each branched outlet conduit having a central passageway having a proximate end in communication with an exit end of the respective holding chamber and a plurality of branched passageways, each branched passageway in communication with a distal end of the central passageway and terminating in a second end distal to the respective holding chamber. A sealing means is disposed in each branched passageway. The apparatus further includes means defining a plurality of die chambers, each die chamber containing an inlet port defined by a surface of the die chamber. Each inlet port is in communication with a second end of the outlet conduit of each respective holding chamber for the filling of each said die chamber with extruded feed material. Means for monitoring the filling of each die chamber of said plurality of die chambers with extruded feed material and moving means for opening in and closing each sealing means is provided, the monitoring means capable of generating an input signal and the moving means responsive to the input signal of the monitoring means. The present aspect of the invention can also embody an apparatus containing a single passageway, a single holding chamber, a single branched outlet conduit and a plurality of die chamber means.

In preferred embodiments, each holding chamber is in communication with a respective passageway by way of a first conduit connecting an aperture defined in an interior surface of the respective passageway with an entry end of the respective holding chamber. The frictional extrusion source further includes a first moving surface and a second non-moving surface in facing relationship, the first and second surfaces defining between them a passageway.

In other preferred embodiments, a die chamber may have one or more inlet ports. The inlet ports are positioned along the surface of the die chamber such that the extrusion pressure required to maintain advance of the extrusion front is minimized. By "extrusion front" as that term is used herein, it is meant the furthermost boundary of extruded material from a particular inlet port. Extrusion pressure can be minimized by locating the inlet ports at positions of large cross-sectional area in the die chamber. Inlet port location may also selected to minimize the path length of the outlet conduit of the holding chamber. The orientation of the die chamber may be selected to minimize outlet conduit path length.

In a preferred embodiment, the frictional extrusion source includes first moving surface and a second non-moving surface in facing relationship, the first and second surfaces defining between them a passageway, the passageway including an entry point for introduction of a feed material and an exit point for release of a frictionally extruded feed material. In another embodiment of the present invention, the frictional extrusion source includes a first moving surface and a second non-moving surface in facing relationship, the first and second surfaces defining between them a passageway, the passageway capable of translational movement in a direction perpendicular to the direction of the moving surface from a first position in communication with a first holding chamber to a second of a plurality of positions in communication with a second of a plurality of holding chambers. In other preferred embodiments, the holding chamber is equipped with mixing blades.

In other preferred embodiments of the invention, monitoring means may be located at points within the die chamber having a local smallest cross-sectional area. By "local smallest cross-sectional area", as that term is used herein, it is meant a location within the die chamber that has the smallest cross-sectional area for a given region of the die chamber. There may be several "local smallest cross-sectional areas" within a single die chamber.

Monitoring means may also take be located at points within the die chamber at a preselected distance from the inlet port. The pre-selected distance will typically be the point furthest from the inlet point. In a system where more than one inlet port is used, there may be more than one pre-selected distance, reflecting regions within the die chamber furthest from each of the inlet ports and at positions where extrusion fronts of different inlet ports are predicted to make contact.

Monitoring means include devices utilizing ultrasonic, pressure, electromagnetic, laser ultrasonic and inductive techniques. In particular, means utilizing pressure sensing techniques are the desired method for monitoring the progress of the extrusion front.

In other embodiments of the invention, the apparatus includes means for ejecting the shaped article from the die chamber. The apparatus may further include heating means for heating the holding chamber(s) and outlet conduit(s). Heating means include, but are in no way limited to, an externally located furnace surrounding the holding chamber(s) and outlet conduit(s) and resistive current heating. The heating means preferably maintains the extruded feed material at 0.5–0.9 $T_m$. Sealing means disposed within the outlet conduits may also be heated, preferably by resistive current heating.

The apparatus of the present invention provide a means for continuously extruding a complex shaped article of non-uniform cross-sectional area, in which the advantages of both continuous extrusion and metalworking techniques can be realized. A method for obtaining continuously extruded shaped articles is also provided.

BRIEF DESCRIPTION OF THE DRAWING

The invention is described with reference to the following drawings, in which.

DESCRIPTION OF THE PREFERRED EMBODIMENT

Massive metal structures are typically prepared using either casting from molten metal or forging. While casting is often a less expensive procedure, it introduces impurities and/or porosity into the casting which degrades the structure and makes the process unacceptable for certain applications. Forging produces a high quality article at a much greater expense. The metal quality improves during forging operations due to work hardening. During work hardening, plastic deformation changes the dislocation structure of the metal, resulting in an increase in strength or stress of the metal. Plastic deformation should occur at temperatures that are low relative to the melting point of the metal.

Continuous extrusion provides plastic deformation on a continuously fed material. Hence, it is possible to work harden the finished article, while using a continuous and less expensive process. The present invention provides an apparatus and method for preparing shaped articles having properties approaching those of forged articles, while using a continuous frictional extrusion technology.

The present invention is a method and apparatus for extruding a feed material using a frictional extrusion source for the continuous production of shaped articles. The apparatus includes a conventional frictional extrusion source, such as the one described hereinbelow. The frictional extrusion source is in communication with a chamber which holds frictionally extruded material. A plurality of die chambers are provided and a directing means selectively directs extruded material from the holding chamber into each of the die chambers. For reasons of thermal stability, it is desirable that the extrusion apparatus operate continuously, without interruption to remove and replace die chambers. Disruption of the extrusion process causes thermally unstable transients to form and heating is uneven. This then results in metal loss or uneven product quality in the final product. The continuous operation of the frictional extrusion apparatus of the present invention is possible by the coordinated operation of the directing means and monitoring means so that upon filling of one die chamber, extruded material can be directed into the next available die chamber.

Figure 1:
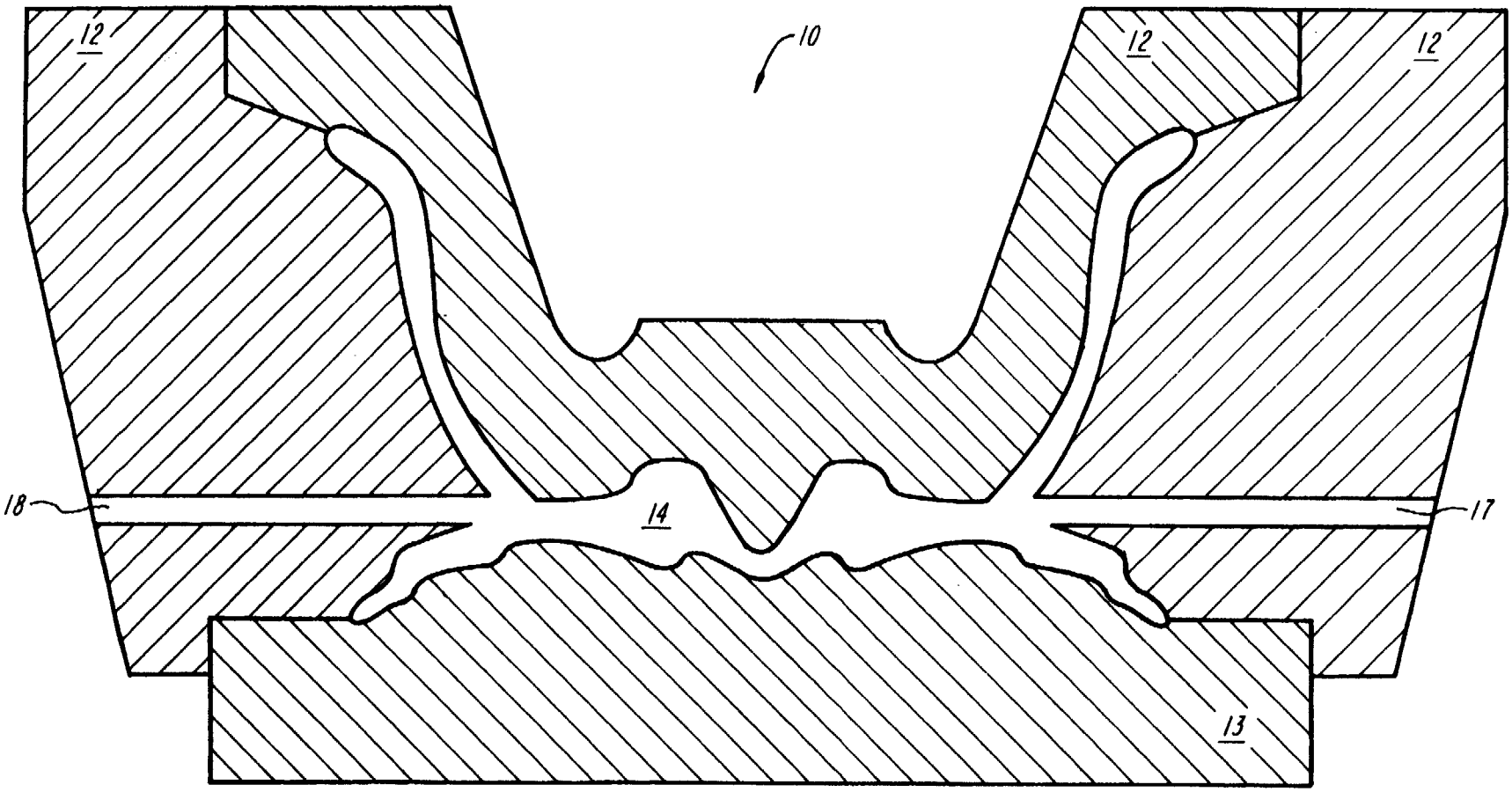
FIG. 1 is a cross-sectional side view of a cylindrically symmetric, multiple inlet port die chamber for a complex shaped article.

In accordance with the invention and with reference to FIG. 1, a die chamber 10 is disclosed which is suitable for extrusion of an automobile wheel rim. The die chamber of FIG. 1 is intended to be illustrative of the type of die chamber which may be used with the present invention and is in no way intended to limit the scope of the invention. At least two separable sections are required, however, more may be preferred for larger or more complex structures. The chamber is made up of sectional dies 12 and a mandrel 13 which, when assembled, provides a void 14 having the geometry of the shaped article. By way of illustration, inlet ports 17 and 18 are shown at the juncture of the wheel rims and center channels. Location of the inlet ports at these cites results in a low initial extrusion pressure because of the large cross-section. However, inlet ports are located as dictated by the shape and structure of the frictional extrusion apparatus as discussed hereinbelow.

Figure 2:
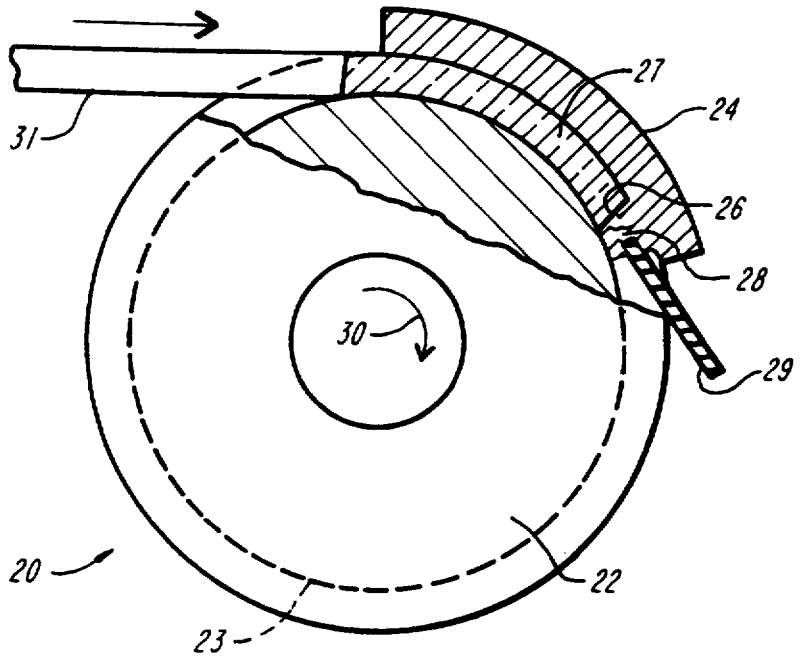
FIG. 2 (PRIOR ART)
FIG. 2 is a cross-sectional view of a conventional frictional extrusion apparatus.

With reference to FIG. 2, a conventional frictional extrusion source suitable for use in the present invention is described. The extrusion apparatus 20 has a rotatable wheel 22 having a circumferential endless groove 23 therein. The groove 23 is engaged with a shoe member 24 having an abutment 26 which intrudes into the groove 23, thereby blocking the whole of passageway 27 which is defined by the groove 23 and shoe member 24. An opening 28 is positioned near the abutment 26 for release of a frictionally extruded feed material 29. The opening 28 can be situated in the shoe so that the extrusion product 29 is emitted either radially or tangentially from the wheel. FIG. 2 depicts the die extending tangentially outward from the groove.

In operation according to the present invention, the wheel 22 is rotated in the direction indicated by arrow 30. A feed material 31 moves forward into passageway 27 where it meets abutment 26. The frictional drag on the feed material 31 softens the material and creates sufficient frictional pressure to extrude the feed material through opening 28. The extrusion apparatus 20 may contain one or more passageways 27.

Figure 3:
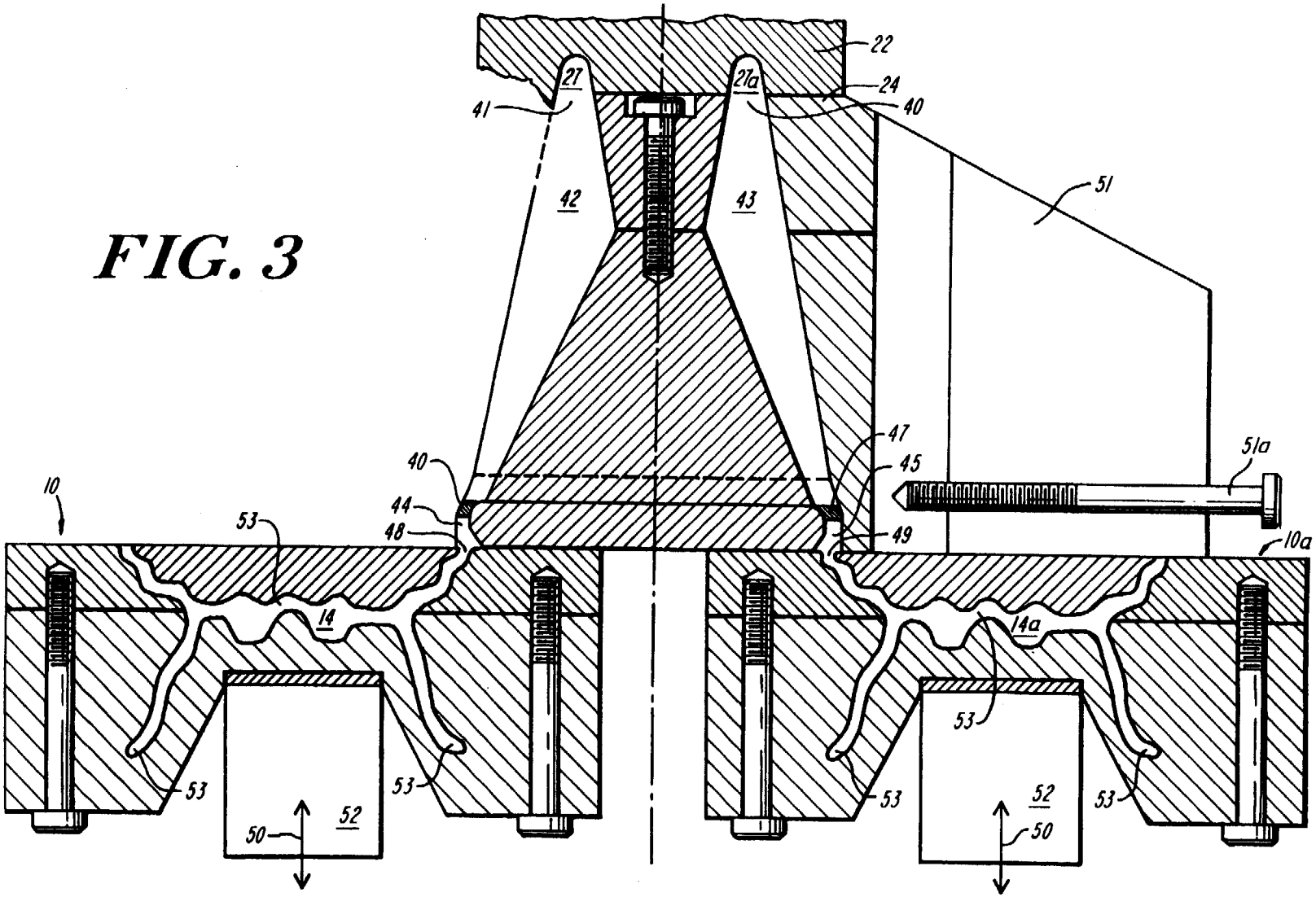
FIG. 3 is a cross-sectional view of a first embodiment of single inlet port frictional extrusion apparatus of the present invention with the axis of symmetry of the die chambers perpendicular to the axis of rotation of the frictional extrusion wheel.
Figure 4:
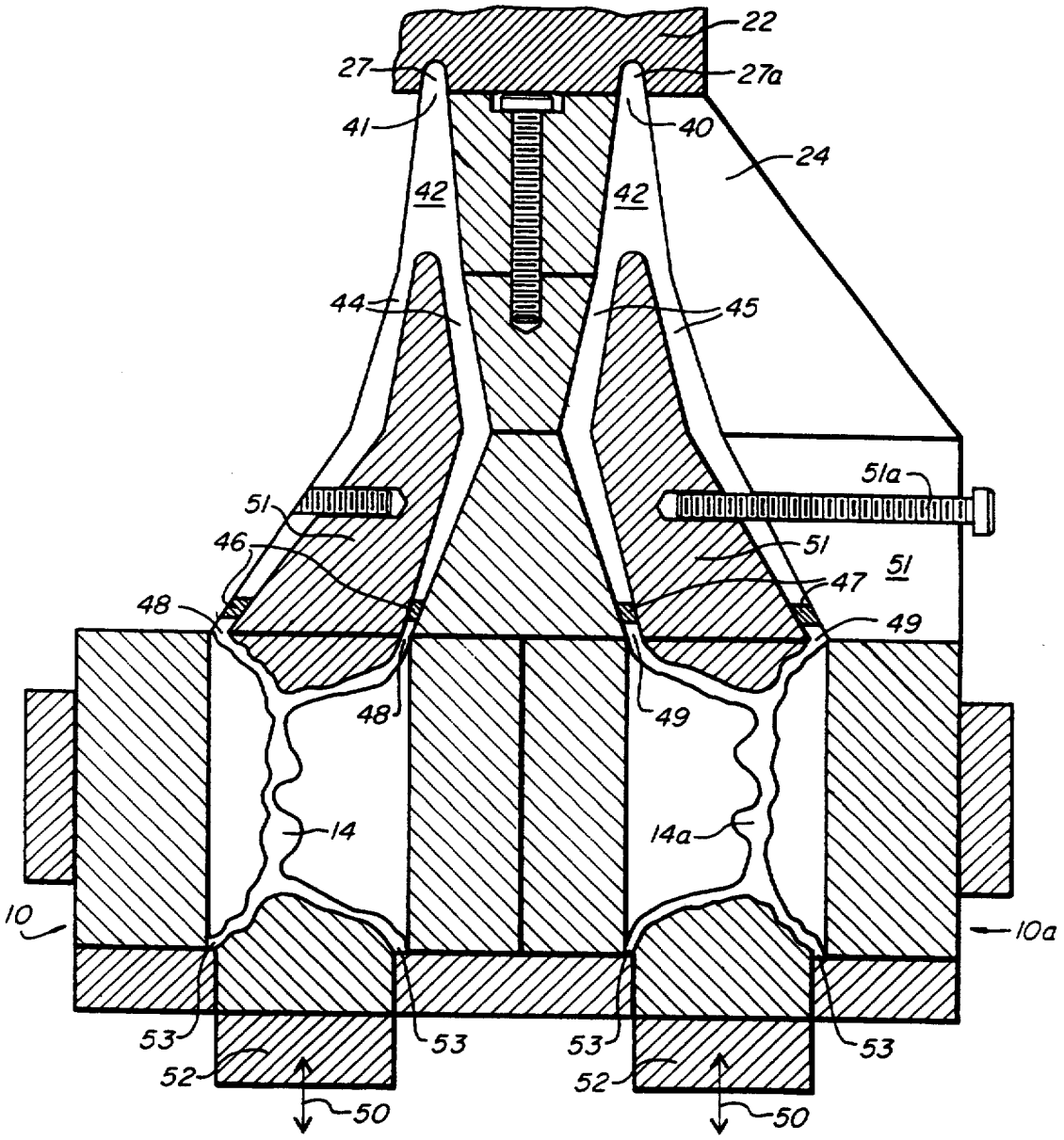
FIG. 4 is a cross-sectional view of a first embodiment of a multiple inlet port frictional extrusion apparatus of the present invention with the axis of symmetry of the die chambers parallel to the axis of rotation of the frictional extrusion wheel.

FIGS. 3 and 4 are cross-sectional views of a first embodiment of the frictional extrusion apparatus of the invention for the continuous extrusion of shaped articles, where like elements are similarly numbered. Portions of the apparatus have been removed around an axis of symmetry in FIG. 3 for clarity. FIG. 3 is shown for an apparatus having two passageways, two holding chambers and two die chambers. It is understood that the scope of the present invention is not limited thereby and any number of passageways and holding and die chambers is within the scope of the present invention.

The rotatable wheel 22 and shoe 24 which define passageways 27 and **27*a* are shown, in part, in the upper portion of FIG. 3. A plurality of first conduits 40 and 41 connect the respective passageways 27 and 27*a* to an entry end of respective holding chambers 42 and 43. The holding chambers 42 and 43 are capable of receiving frictionally extruded material from the extrusion source. Within the holding chamber, the extruded material is spread across a large cross-sectional area to permit the filling of a die chamber having cross sectional area larger than the cross-sectional area of the feed material. The holding chambers 42 and 43 additionally promote the mixing of the material prior to extrusion form a more homogeneous mixture. Mixture of the extruded material can be further promoted by inclusion of mixing blades (not shown) in the holding chambers 42 and 43. Outlet conduits 44 and 45 are located at an exit end of the respective holding chambers 42 and 43**.

Die chambers 10 and 10a which define voids 14 and 14a as described hereinabove include at least one respective inlet port 48 and 49, through which feed material is introduced from the holding chambers via the outlet conduits. FIG. 3 shows a frictional extrusion apparatus having a single inlet port per die chamber. FIG. 4 shows a frictional extrusion apparatus where the orientation of the die chambers has been altered to permit two inlet ports per die chamber. The ease of access of the outlet conduit to the die chamber may suggest the desirability of locating the inlet ports at the extremities of the die chamber.

Inlet ports at locations of large cross-section in the die chamber permit low initial extrusion pressures. By locating inlet ports at area of large cross-sectional area, the initial pressure required to move the extrusion front further into the die chamber is lower. Inlet ports may have any cross-sectional geometry including, but not limited to, elliptical, circular and rectangular geometries. The cross-sectional geometry may even substantially follow the local contour of the die chamber. Inlet port geometry is typically selected to minimize extrusion pressure. Extrusion pressures will increase as the cross-section narrows, however, it is desirable to maintain extrusion pressure as low as possible for as long as possible to minimize stress to the die chamber. These two oftentimes competing factors need to be considered when assembling the apparatus of the present invention.

Inlet ports 48 and 49 are coupled to the respective outlet conduits 44 and 45 of the respective holding chambers 42 and 43 using conventional coupling means, including, but not limited to bolts, fasteners, and the like, and application of transverse pressure (indicated by arrows 50, in FIGS. 3 and 4). Transverse pressure is applied against opposing blocks 51 and 52. Block 51 is securely fastened to the extrusion apparatus using fastener 51a, while block 52 is removable for gaining access to the die chamber.

Outlet conduits 44 and 45 contain respective sealing means 46 and 47 having an open position which allows extruded material to pass through to the die chamber and a closed position blocking egress from the holding chambers. Intermediate positions are contemplated for influencing the flow rate into the die chamber. The sealing means preferably is an opposable gate or valve, preferably heated using a resistive current. The sealing means is preferably heavy duty stainless steel to withstand the high pressures experienced within the holding chamber.

Means are provided to monitor the filling of the each die chamber and to generate an output signal to signal the completion of the die filling operation. Monitors are located in the die chamber at a distance furthest from an inlet port, at a region of local smallest cross-section or at a contact point of extrusion fronts. A single location may satisfy one or more of these conditions. It is expected that these locations will be the last to fill and, hence, monitoring at these points will indicate completion of the filling operation. Suitable locations for monitoring means are noted by 53.

Any conventional monitoring means can be used including, but not limited to, those employing ultrasonic, pressure, electromagnetic, laser ultrasonic (where an ultrasonic pulse is generated by laser) and inductive techniques. Monitoring means may determine contact of separate extrusion fronts, in particular, by using inductive techniques, which monitor the conductivity within the die chamber. Once contact of all separate extrusion fronts is complete, the conductivity increases. Pressure sensors are a particularly preferred method of monitoring the extent of extrusion. The interior die chamber pressure or the pressure of gas escaping through vents provided in the surface of the die chamber as the gas is displaced by extruded material may be monitored. When the interior pressure of the die chamber is monitored, a sharp rise in chamber pressure indicates that the die chamber is filled while the converse is true when monitoring escape gas pressure. A pressure change, change in conductivity or any other indicator, generates an output signal for the activation of sealing means 46 and 47.

The present embodiment operates in the following manner. The extrusion apparatus first introduces a feed material into passageway 27 as described above with reference to FIG. 2. The extruded material is directed through conduit 41 into holding chamber 42. The outlet conduit 44 directs the extruded feed material from the holding chamber 42 to the inlet port 48 of the die chamber 10 defining void 14. Monitors positioned at 53 monitor the extent of filling of the void 14 and generates an output signal when predetermined conditions are met, i.e., a change in chamber pressure, thereby indicating the completion of the filling of void 14. Sealing means 46, responsive to the output signal of the monitoring means, moves from an open position to a closed position, halting egress of the extruded material from the holding chamber 42 and halting further introduction of feed material into passageway 27. The output signal from the monitoring means concurrently activates the introduction of feed material into passageway 27a and moves sealing means 47 from a closed position to an open position. The extruded material is directed through conduit 40 into holding chamber 43. The outlet conduit 45 then directs the extruded feed material from the holding chamber 43 to the inlet port 49 of the die chamber 10a defining void 14a. During filling of void 14a, die chamber 10 is removed from the extrusion apparatus by release of block 52 along a pathway shown by arrow 50 and is disassembled to eject a shaped article. The now-empty die chamber 10 is then reassembled and recoupled to outlet conduit 44 for subsequent refilling. Monitoring means then indicate completion of the falling of void 14a and activate the closing of sealing means 47 and the halting of feed material to passageway 27a as described for the failing of void 14. It may be desirable upon subsequent filling of die chamber 10 to initiate introduction of feed material into passageway 27a prior to recoupling of die chamber 10 to allow stable extrusion conditions to be reestablished before filling. To summarize, continuous operation of the extrusion apparatus is possible by intermittent feeding of material to passageways 27 and 27a, coupled with the activation of sealing means 46 and 47.

It may be desirable to provide additional heating to the holding chambers and outlet conduits to maintain the extruded feed material at elevated temperatures (which improves its plasticity). In particular, the temperature is maintained at substantially 50–90% of the melting point of the feed material (0.5–0.9 $T_m$). Heating can be accomplished by external heating means surrounding the holding chambers and the outlet conduits, including, but in no means limited to, resistance furnaces and graphite coils. It is particularly desirable to heat interior walls of the holding chamber as these surfaces are in immediate contact with the extruded feed material. Heating of the interior walls may be accomplished using resistive current heating. It may also be desirable to selectively heat the vicinity of an interface formed at a contact point of two extrusion fronts formed by the extrusion through the plurality of inlet ports.

Depending on the geometry of the shaped article and the size of the die chamber, the path length of the outlet conduit will vary. It is desirable to select the die chamber orientation and the inlet port locations to minimize such distance. In FIG. 3, the die chambers are positioned such that longest dimension is parallel to the axis of wheel 22. This orientation permits the use of multiple inlet ports having a minimal path length for each outlet conduit. FIG. 4 illustrates an alternative orientation for the die chambers, in which the die chambers are positioned such that the longest dimension is perpendicular to the axis of wheel 22. Further, FIG. 4 illustrates the first embodiment in which multiple outlet conduits/inlet ports are used.

Figure 5:
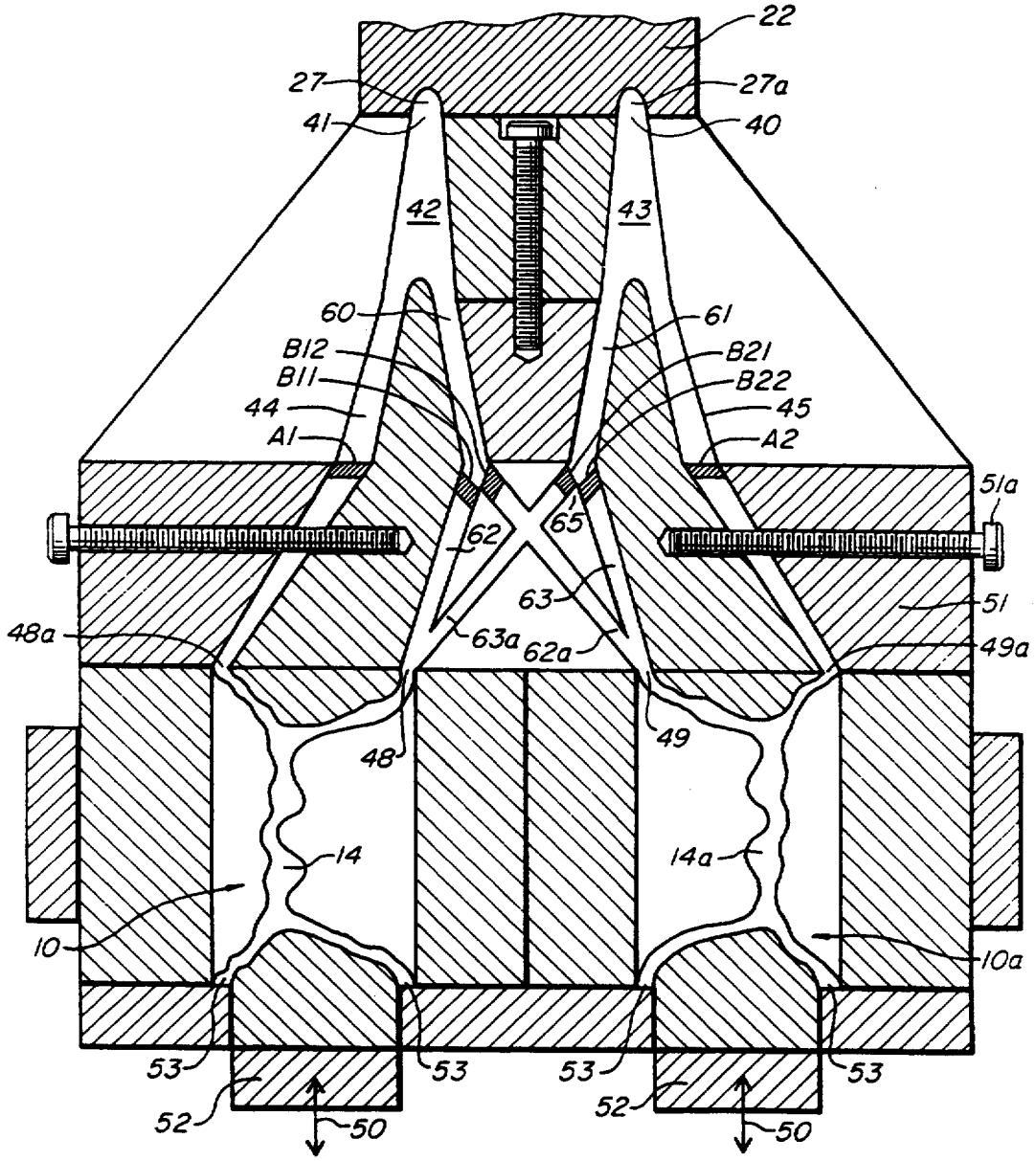
FIG. 5 is a cross-sectional view of a second embodiment of the frictional extrusion apparatus of the present invention.

A second embodiment of the fictional extrusion apparatus is described with reference to FIG. 5, where like elements are similarly numbered. FIG. 5 is shown for an apparatus having two passageways and two holding and die chambers. It is understood that the scope of the present invention is not limited thereby and any number of passageways and holding and die chambers is within the scope of the present invention.

A plurality of first conduits 40 and 41 connect the respective passageways 27 and 27a to an entry end of respective holding chambers 42 and 43. The holding chambers 42 and 43 are capable of receiving frictionally extruded material in an amount sufficient for the filling of die chambers of large cross-sectional area.

A particular feature of the second embodiment includes branched outlet conduits including central passageways 60 and 61 having proximal ends at an exit end of the respective holding chambers 42 and 43. Each respective branching passageway 62 and 63 is joined at a distal end of the respective central passageways 60 and 61. Branching passageways 62 and 62a are in communication with the adjacent die chambers 10 and 10a, respectively. Branching passageways 63 and 63a are in communication with adjacent die chambers 10a and 10, respectively. Branching passageways form an angle $\theta$ 65 which defines the angle of bifurcation of the branched passageways. To minimize extrusion pressure and feed material flow resistance, it is desirable that the angle $\theta$ be kept at a low value. The angle $\theta$ is preferably in the range of 1 to 75 degrees and more preferably in the range of 30 to 40 degrees.

Die chambers 10 and 10a which define voids 14 and 14a as described hereinabove include respective inlet ports 48 and 49, through which feed material is introduced from the holding chambers via the outlet conduits. Inlet ports 48 and 49 are coupled to the respective branched passageways (60 for port 48; 61 for port 49). The extrusion apparatus may optionally include unbranched outlet conduits 44 and 45 located at an exit end of the respective holding chambers 42 and 43, as in the first embodiment of the invention, which are coupled to inlet ports 48a and 49a, respectively. Couple includes conventional coupling means, including, but not limited to bolts, fasteners, and the like, and application of transverse pressure (indicated by arrows 50, in FIG. 5) Transverse pressure is applied against opposing blocks 51 and 52. Block 51 is securely fastened to the extrusion apparatus using fastener 51a, while block 52 is removable for gaining access to the die chamber.

Outlet conduits 44 and 45 contain respective sealing means A1 and A2, therein. Outlet conduits 44 and 45 are not in communication with each other. Outlet conduit 60 contains sealing means B12 and the respective branching member 62 contains sealing means B11. Outlet conduit 61 contains sealing means B21 and the respective branching member 63 contains sealing means B22. All sealing means have a first open position which allows extruded material to enter the die chamber and a second closed position which blocks egress from the holding chamber. It is preferable that the sealing means are heated.

Monitoring means are provided as described above for the first embodiment. Suitable locations for monitoring means are noted by 53. As for the first embodiment, heating of the holding chambers, outlet conduits and sealing means may be desirable; and location and geometry of outlet ports and orientation of the die chambers is selected to minimize extrusion pressure.

In operation, it is possible to have both continuous operation of the extrusion apparatus and continuous introduction of the feed material. The extrusion apparatus introduces a feed material into passageways 27 and 27a as described above with reference to FIG. 2. The extruded material is directed through conduits 41 and 40 into holding chamber 42 and 43, respectively. The respective outlet conduits direct the extruded feed material from the respective holding chambers to the respective inlet ports via a number of routes. Modes of operation include the following:

(a) Holding chamber 42 supplies feed material exclusively to extrusion die 10. In this mode, sealing means A1 and B11 are open and gate B12 is closed. No feed material is introduced into holding chamber 43.

(b) Holding chamber 43 supplies feed material exclusively to extrusion die 10a. In this mode, sealing means A2 and B22 are open and gate B21 is closed. No feed material is introduced into holding chamber 42.

(c) Holding chamber 42 supplies feed material exclusively to extrusion die 10 and holding chamber 43 supplies feed material exclusively to extrusion die 10a. In this mode, sealing means A1, A2, B22 and B11 are open and sealing means B12 and B21 are closed.

(d) Holding chambers 42 and 43 supply die chamber 10 while die chamber 10a is disassembled and the shaped article is ejected. In this mode, sealing means A1, B11 and B21 are open and sealing means A2, B12 and B22 are closed.

(e) Holding chambers 42 and 43 supply die chamber 10a while die chamber 10 is disassembled and the shaped article is ejected. In this mode, sealing means A2, B12 and B22 are open and sealing means A1, B21 and B11 are closed.

Monitors positioned at 53 monitor the extent of filling of the void 14 and generates an output signal when predetermined conditions are met, thereby indicating the completion of the filling of void 14. The appropriate sealing means, responsive to the output signal of the monitoring means, moves from an open position to a closed position, or vice versa, halting egress of the extruded material from the one holding chamber and directing further introduction of feed material into a second holding chamber, as appropriate.

In all of the above filling scenarios, it is possible to have the sealing means in intermediate positions and to regulate the rate of feed material introduction into the passageways. The means for regulating the rate of feed material introduction into the passageway may be responsive to the monitoring means. To avoid a situation where, both die chamber 10 and 10*a* require replacement at the same time, the apparatus operates so that there is an optimum lag between the extent of fill of the two die chambers. For example when die chamber 10 is completely filled, die chamber 10*a* is optimally one-tenth full. This will largely depend on the size and cross-section of the void to be filled and the feed rate of the feed material.

When, for example, sealing means A1, B11 and B21 are shut for replacement of die chamber 10 and both holding chamber supply die chamber 10*a*, a sudden increase in the feed rate may be experienced. This can be adequately compensated for by using intermediate positions of the opened sealing means, i.e., partially opened positions or by adjusting the rate of introduction of feed material into the passageways.

Operation of the present embodiment is possible using a single passageway, holding chamber and branched outlet conduit. In this mode, continuous extrusion of shaped articles is possible by alternating direction of the extruded material between the branched passageways. However, the volume of feed material capable of being processed ("through-put") is significantly reduced by the availability of only one passageway.

Figure 6B:
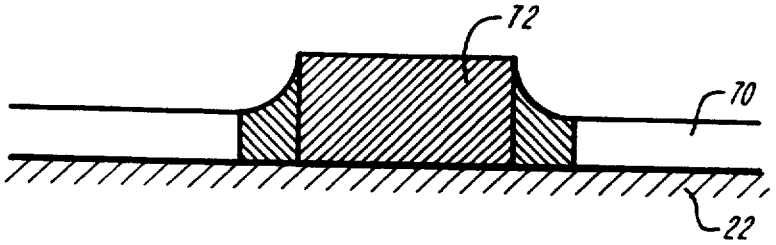
FIG. 6(*a*) is a top view of a frictional extrusion source illustrating a passageway capable of translational motion and (*b*) is a side view of a support block for the passageway.
Figure 6A:
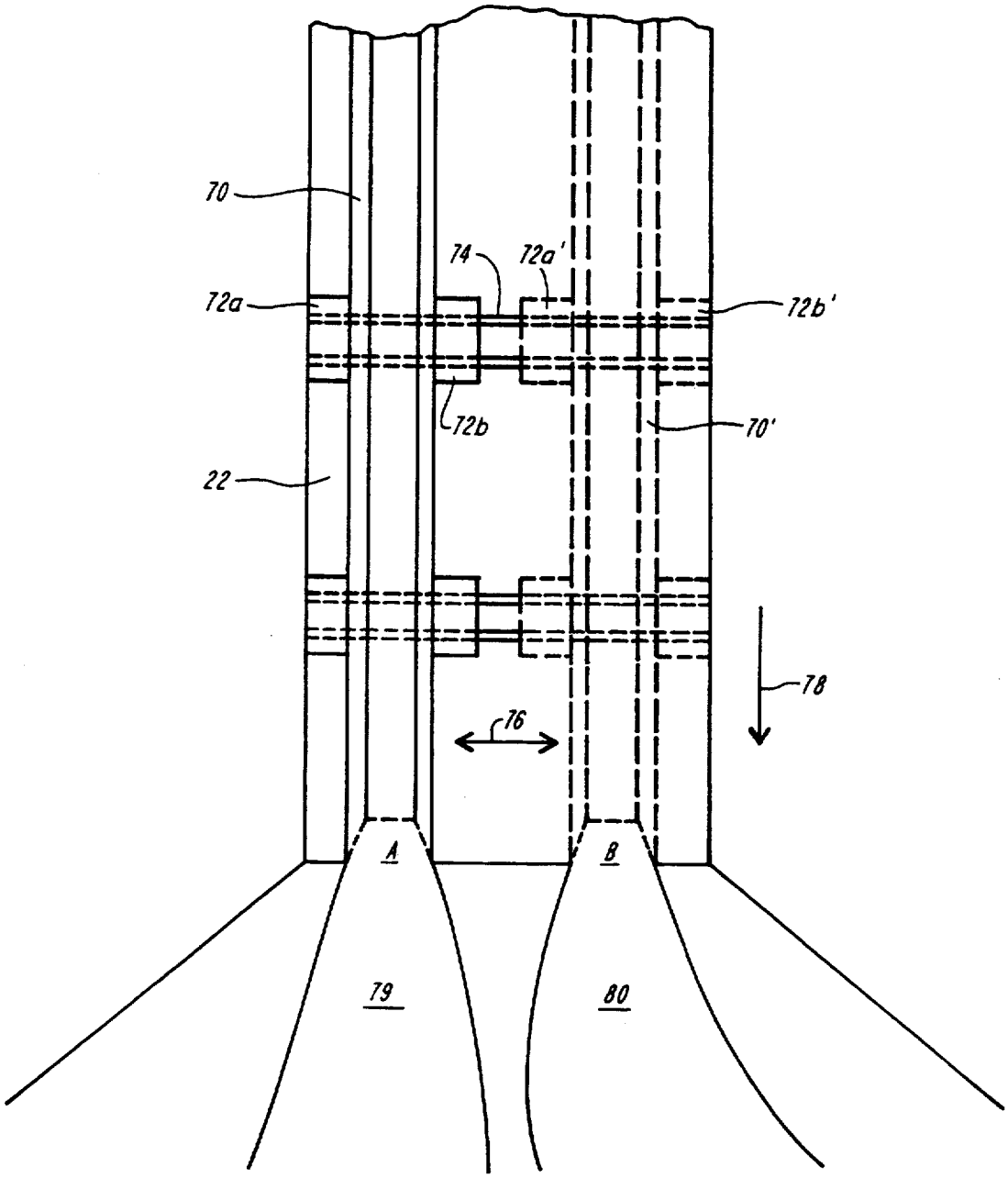

FIG. 6(*a*) is a top view of a frictional extrusion source illustrating a passageway capable of translational motion. FIG. 6(*b*) is a side view of support blocks used to support the movable passageway. The frictional extrusion source with movable passageway may be used with any of the frictional extrusion apparatuses of the invention for the continuous extrusion of shaped articles. It is understood that the scope of the present invention is not limited thereby and any number of passageways and holding and die chambers is within the scope of the present invention.

With reference to FIGS. 6 (*a*) and (*b*), a passageway 70, is circumferentially mounted on and separable from the rotating wheel 22. The passageway 70 is preferably a machined channel of heavy gauge steel capable of withstanding the extrusion pressures generated in operation without distortion or buckling. The passageway 70 is supported by pairs of opposing support blocks 72*a* and 72*b* positioned along the length of the passageway 70. The support blocks are mounted on a rail 74, which substantially traverses the width of the wheel 22. The number of support blocks 72 (and hence, rails 74) is determined by the dimension of the wheel and of the feed material. A sufficient number of support blocks should be used to minimize vibrations or any other lateral displacement of the feed material.

The support block/passageway combination is capable of translational movement along the rails 74 in the direction indicated by arrow 76. This direction is perpendicular to the direction of rotation of the wheel 22 indicated by arrow 78. The support blocks both slide along the rails 74 and may be locked into position at a predetermined location using suitable locking means. The blocks are also of sufficient height above the surface defined by the wheel 22 to permit application of lateral pressure to reversibly shift the support block/passageway assembly from a first position A to a second position B. Preferred shapes for support blocks are shown in FIG. 6(*b*). More than two positions on the wheel are of course contemplated and are within the scope of the present invention.

The first position A brings passageway 70 in communication with a holding chamber 79. The support block/passageway assembly can be moved along rails 74 to position B in communication with a holding chamber 80. The new position is denoted by dashed line support blocks 72*a*' and 72*b*' and dashed line passageway 70'. Because extrusion pressure is generated by motion of the wheel 22 along the direction of arrow 78, motion perpendicular to this direction causes the immediate cessation of extrusion pressure. The translational motion itself acts as a gate to cut off flow of extruded material during translation of the passageway from position A to position B. Of course, it is still desirable to accomplish the translational motion as quickly as possible to minimize thermal instability of the feed material.

Due to friction, significant heat is generated in the passageway, which is necessary to frictional extrusion. However, by raising the passageway above the wheel surface, the passageway/ambient interface increases significantly and undesirable heat loss may occur. This can be minimized by coating the outer walls of the passageway with a thermally insulating layer, such as a non-conducting ceramic. Also, the metal surface of the support blocks in contact with the passageway can be coated with an abrasion-resistant layer.

Other embodiments of the invention will be apparent to those skilled in the art from a consideration of the specification or practice of the invention disclosed herein. It is intended that the specification and examples be considered as exemplary only, with the true scope and spirit of the invention being indicated by the following claims.

What is claimed is:

1. A frictional extrusion apparatus for continuous extrusion of shaped articles, comprising:

a frictional extrusion source;

at least one chamber for holding frictionally extruded material received from the extrusion source;

means defining a plurality of die chambers, each said die chamber receiving extruded material from the holding chamber;

means for directing extruded material from the holding chamber to each die chamber of said plurality of die chambers for selectively filling each said die chamber with extruded feed material; and means for monitoring filling of each die chamber of said plurality of die chambers with extruded feed material, the directing means responsive to the monitoring means.

2. The apparatus of claim 1, wherein each side die chamber comprises an inlet port defined by a surface of the die chamber.

3. The apparatus of claim 2, wherein the location of the inlet port to each said die chamber is selected to minimize the path length of said means for directing extruded material from the holding chamber to each die chamber.

4. A frictional extrusion apparatus for continuous extrusion of shaped articles, comprising;

a frictional extrusion source defining a plurality of passageways, each passageway of said plurality of passageways including an entry point for introduction of a feed material and an exit point for release of frictionally extruded feed material;

a plurality of chambers for holding the frictionally extruded material, each holding chamber of said plurality of chambers in communication with the respective passageway of said plurality of passageways;

a plurality of outlet conduits, each outlet conduit of said plurality of outlet conduits having a first end in communication with an exit end of the respective holding chamber of said plurality of passageways;

sealing means disposed in each said outlet conduit;

means defining a plurality of die chambers, each die chamber of said plurality of die chambers containing an inlet port defined by a surface of the die chamber, each said inlet port in communication with a second end of the respective outlet conduit of said plurality of outlet conduits for receiving extruded feed material;

means for monitoring filling of each die chamber of said plurality of die chambers with extruded feed material, the monitoring means capable of generating an output signal; and means responsive to the output signal of the monitoring means for moving each said sealing means from a first open position to a second closed position.

5. The apparatus of claim 4, wherein each die chamber of said plurality of die chambers comprises a plurality of inlet ports, each of said plurality of inlet ports in communication with the respective outlet conduit.

6. A frictional extrusion apparatus for continuous extrusion of shaped articles, comprising;

a frictional extrusion source defining a plurality of passageways, each passageway of said plurality of passageways including an entry point for introduction of a feed material and an exit point for release of frictionally extruded feed material;

a plurality of chambers for holding the frictionally extruded material, each holding chamber of said plurality of chambers in communication with the respective passageway of said plurality of passageways;

a plurality of branched outlet conduits, each branched outlet conduit of said plurality of branched outlet conduits having a central passageway having a proximate end in communication with an exit end of the respective holding chamber and a plurality of branched passageways, each branched passageway of said plurality of branched passageway having a first end in communication with a distal end of the central passageway and each branched passageway of said plurality of branched passageways terminating at a second end distal to the respective holding chamber;

sealing means disposed in each said branched passageway;

means defining a plurality of die chambers, each die chamber of said plurality of die chambers containing an inlet port defined by a surface of the die chamber, each said inlet port in communication with the second end of the respective branched passageway of the respective branched outlet conduit for receiving extruded feed material;

means for monitoring filling of each die chamber of said plurality of die chambers with extruded feed material, the monitoring means capable of generating an output signal; and means responsive to the output signal of the monitoring means for moving each said sealing means from a first open position to a second closed position.

7. The apparatus of claim 6, further comprising:

a plurality of unbranched outlet conduits, each unbranched outlet conduit of said plurality of unbranched outlet conduits having a first end in communication with an exit end of the respective holding chamber and a second end terminating at the inlet port of the respective die chamber.

8. A frictional extrusion apparatus for continuous extrusion of shaped articles, comprising;

a frictional extrusion source defining a passageway, the passageway including an entry point for introduction of a feed material and an exit point for release of frictionally extruded feed material;

a chamber for holding the frictionally extruded material, the holding chamber in communication with the passageway;

a branched outlet conduit, the branched outlet conduit having a central passageway having a proximate end in communication with an exit end of the holding chamber and having a plurality of branched passageways, each branched passageway of said plurality of branched passageways having a first end in communication with a distal end of the central passageway and each of branched passageway of said plurality of branched passageways terminating at a second end distal to the respective holding chamber;

sealing means disposed in each said branched passageway;

means defining a plurality of die chambers, each die chamber of said plurality of die chambers containing an inlet port defined by a surface of the die chamber, each said inlet port in communication with the second end of the respective branched passageway of the branched outlet conduit for receiving extruded feed material;

means for monitoring fig of each die chamber of said plurality of die chambers with extruded feed material, the monitoring means capable of generating an output signal; and means responsive to the output signal of the monitoring means for moving each said sealing means from a first open position to a second closed position.

9. The apparatus of claim 4, 6 or 8, wherein each said holding chamber is in communication with the respective passageway by way of a first conduit connecting the aperture of the passageway with an entry end of the respective holding chamber.

10. The apparatus of claim 4, 6 or 8, further comprising:

means for regulating a rate of a feed material introduction into each said passageway.

11. The apparatus of claim 6 or 8, wherein each die chamber of said plurality of die chambers comprises a plurality of inlet ports, at least one of said plurality of inlet ports in communication with the respective branched passageway of the respective branched outlet conduit and at least one of said plurality of inlet ports in communication with a respective unbranched outlet conduit, the outlet conduit having a first end in communication with an exit end of the respective holding chamber and a second end terminating at the inlet port of the respective die chamber.

12. The apparatus of claim 6 or 8, wherein each said branching passageway of said branched outlet conduit branches at an angle $\theta$ in the range of 1 to 75 degrees.

13. The apparatus of claim 1, 4, 6 or 8, wherein said frictional extrusion source includes a first moving surface and a second non-moving surface in facing relationship, the first and second surfaces defining between them a passageway, the passageway including an entry point for introduction of a feed material and an exit point for release of a frictionally extruded feed material.

14. The apparatus of claim 1, 4, 6 or 8, wherein said frictional extrusion source includes a first moving surface and a second non-moving surface in facing relationship, the first and second surfaces defining between them a passageway, the passageway capable of translational movement in a direction perpendicular to the direction of the moving surface from a first position of a plurality of positions in communication with a first holding chamber to a second position of a plurality of positions in communication with a second of a plurality of holding chambers.

15. The apparatus of claim 14, further comprising: means for ejecting a shaped article from the filled die chamber.

16. The apparatus of claim 14, further comprising: heating means for heating the holding chamber(s) and outlet passageway(s).

17. The apparatus of claim 14, wherein said sealing means is heated.

18. The apparatus of claim 14, further comprising:

heating means located in the vicinity of an interface formed at a contact point of two extrusion fronts formed by the extrusion of said feed material through each said inlet port.

19. The apparatus of claim 1, 4, 6 or 8, wherein said monitoring means is selected from the group consisting of monitors using ultrasonic, pressure, electromagnetic, laser ultrasonic and inductive techniques.

20. The apparatus of claim 1, 4, 6 or 8, wherein said monitoring means determines interior die chamber pressure.

21. The apparatus of claim 1, 4, 6 or 8, wherein said monitoring means determine gas pressure escaping from vents provided in a surface of each said die chamber.

22. The apparatus of claim 2, 4, 6 or 8, wherein said monitoring means is located within each said die chamber at a distance furthest from a preselected inlet port.

23. The apparatus of claim 1, wherein said monitoring means is located within each said die chamber at a position having a local smallest cross-sectional area.

24. The apparatus of claim 4, 6 or 8, wherein the location of the inlet port to each said die chamber is selected to minimize the path length of a preselected outlet conduit.

25. The apparatus of claim 2, 4, 6 or 8, wherein the location of the inlet port of each said die chamber is selected to minimize initial extrusion pressure.

26. The apparatus of claim. 1, 4, 6 or 8, further comprising: means for ejecting a shaped article from the filled die chamber.

27. The apparatus of claim 4, 6 or 8, further comprising: heating means for heating the holding chamber(s) and outlet conduit(s).

28. The apparatus of claim 27, wherein heating means comprise an externally located furnace surrounding the holding chamber(s) and outlet conduit(s).

29. The apparatus of claim 27, wherein heating means comprise resistive current heating internally located within the holding chamber(s) and outlet conduit(s).

30. The apparatus of claim 4, 6 or 8, wherein said sealing means is heated.

31. The apparatus of claim 30, wherein said heated sealing means is heated using resistive current heating.

32. The apparatus of claim 4, 6 or 8, wherein a cross-sectional geometry of the inlet port of each said die chamber conforms substantially to the geometry of a region of said die chamber.

33. The apparatus of claim 1, 4, 6 or 8, wherein said holding chamber contains mixing blades therein.

34. The apparatus of claim 4, 6 or 8, wherein communication of the die chamber inlet ports to the respective outlet conduit is accomplished using application of transverse pressure.

35. The apparatus of claim 2, 4, 6 or 8, further comprising:

heating means located in the vicinity of an interface formed at a contact point of two extrusion fronts formed by the extrusion of said feed material through each said inlet port.

36. A method for continuous extrusion of shaped articles, comprising:

introducing a feed material into a frictional extrusion source;

receiving the extruded feed material in at least one chamber for holding frictionally extruded material;

providing means defining a plurality of die chambers for receiving extruded material from the holding chamber;

directing extruded material from the holding chamber to each die chamber of said plurality of die chambers for selectively filling each said die chamber with extruded feed material; and monitoring falling of each die chamber of said plurality of die chambers with extruded feed material, whereby upon filling a first die chamber of said plurality of die chambers, extruded material is directed from the holding chamber to a subsequent die chamber of said plurality of die chambers.

37. The method of claim 36, wherein each of said die chambers comprises an inlet port defined by a surface of said die chamber.

38. A method for continuous extrusion of shaped articles, comprising:

providing a frictional extrusion source defining a plurality of passageways, each passageway of said plurality of passageways including an entry point for introduction of a feed material and an exit point for release of frictionally extruded feed material;

extruding a feed material into a first chamber of a plurality of chambers for holding the frictionally extruded material;

directing the feed material through a first outlet conduit of a plurality of outlet conduits into a means defining a first die chamber of a plurality of die chambers, each outlet conduit of said plurality of outlet conduits having a first end in communication with an exit end of the respective holding chamber and each die chamber of said plurality of die chambers containing an inlet port defined by a surface of the die chamber, each said inlet port in communication with a second end of the outlet conduit of the respective holding chamber for receiving extruded feed material;

monitoring filling of each die chamber of said plurality of die chambers with extruded feed material, whereby upon filling of the first die chamber of said plurality of die chambers, the first outlet conduit of said plurality of outlet conduits is sealed and a subsequent outlet conduit of said plurality of outlet conduits is opened and whereby a feed material is extruded into a subsequent holding chamber of said plurality of holding chambers for filling a subsequent die chamber of said plurality of die chambers.

39. A method for continuous extrusion of shaped articles, comprising:

providing a frictional extrusion source defining a plurality of passageways, each passageway of said plurality of passageways including an entry point for introduction of a feed material and an exit point for release of frictionally extruded feed material;

extruding a feed material into a plurality of chambers for holding the frictionally extruded material, each holding chamber of said plurality of chambers in communication with a respective passageway by way of a first conduit connecting an aperture defined in an interior surface of the respective passageway with an entry end of the respective holding chamber;

directing the feed material through a first branched outlet of a plurality of branched outlet conduits into a means defining a first die chamber of a plurality of die chambers, each of said branched outlet conduits having a central passageway having a proximal end in communication with an exit end of the respective holding chamber, each said branched outlet conduit having a plurality of branched passageways, each said branched passageway having a first end joined at a distal end of the central passageway and each of said branched passageways terminating at a second end distal to the respective holding chamber and each die chamber of said plurality of die chambers containing an inlet port defined by a surface of the die chamber, each said inlet port in communication with a second end of the respective branched passageway of each branched outlet conduit for receiving extruded feed material;

monitoring filling of each die chamber of said plurality of die chambers with extruded feed material, whereby upon filling of the first die chamber of said plurality of die chambers, the first branched passageway of said plurality of branched passageways is sealed and a subsequent branched passageway of said plurality of branched passageways is opened and whereby a feed material is directed into a subsequent die chamber of said plurality of die chambers.

40. The method of claim 36, 38 or 39, wherein said monitoring is accomplished using a sensing technique selected from the group consisting of ultrasonic, pressure, electromagnetic, laser ultrasonic, and inductive techniques.

41. The method of claim 37, 38 or 39, wherein said monitoring occurs at points within the die chamber at a preselected distance from the inlet port.

42. The method of claim 36, 38 or 39, wherein said monitoring occurs at points within the die chamber having a local smallest cross-sectional area.

43. The method of claim 36, 38 or 39, said feed material is extruded at an elevated temperature.

44. The method of claim 40, wherein said temperature is substantially 0.8 $T_m$.

45. The method of claim 38 or 39, wherein communication of the die chamber inlet ports to the respective outlet conduit is accomplished using application of transverse pressure.

46. The method of claim 37, 38 or 39, further comprising the step of: heating at a contact point of two extrusion fronts formed by the extrusion through the plurality of inlet ports by selectively heating the die chamber in the vicinity of the contact point.

* * * * *

UNITED STATES PATENT AND TRADEMARK OFFICE

CERTIFICATE OF CORRECTION

PATENT NO. : 5,383,347

DATED : January 24, 1995

INVENTOR(S) : Alfredo Riviere V. and Navtej S. Saluja

It is certified that error appears in the above-indentified patent and that said Letters Patent is hereby corrected as shown below:

On the title page:
In the Inventors item [76], please change the name of the first named inventor from "Alfredo V. Riviere" to "Alfredo Riviere V.";
Item [19] should read --Riviere V. et al--

Column 1, line 28: please delete "fictional" and insert therefor -- frictional --;

Column 1, line 55: before "large" please delete "a";

Column 2, line 32: please delete "fig" and insert therefor -- filling --;

Column 2, line 40: please delete "means" and insert therefor -- mean --;

Column 7, line 55: after "of" and before "each" please delete "the";

Column 8, line 50: please delete "falling" and insert therefor -- filling --;

Column 9, line 25: please delete "fictional" and insert therefor -- frictional --;

Column 14, line 41: please delete "fig" and insert therefor -- filling --;

Column 15, line 28: please delete "passageway(s)" and insert therefor -- conduit(s) --;

UNITED STATES PATENT AND TRADEMARK OFFICE

CERTIFICATE OF CORRECTION

PATENT NO. : 5,383,347

DATED : January 24, 1995

INVENTOR(S) : Alfredo Riviere V. and Navtej S. Saluja

It is certified that error appears in the above-indentified patent and that said Letters Patent is hereby corrected as shown below:

Column 15, line 46: please delete "2" and insert therefor --1 --;

Column 15, line 49: please delete "1" and insert therefor -- 1, 4, 6 or 8 --; and Column 18, line 29: please delete "40" and insert therefor -- 43 --.

Signed and Sealed this

Fourteenth Day of November, 1995

*Attest:*

Bruce Lehman

BRUCE LEHMAN

*Attesting Officer*

*Commissioner of Patents and Trademarks*